US005901992A

United States Patent [19]

Winkler

[11] Patent Number: 5,901,992

[45] Date of Patent: May 11, 1999

[54] ELECTROMECHANICAL LOCKING MECHANISM FOR DOOR LEAVES HAVING A DOOR CLOSING DEVICE

[75] Inventor: Bernd Winkler, Breckerfeld, Germany

[73] Assignee: DORMA GmbH+ Co. KG, Ennepetal, Germany

[21] Appl. No.: 08/804,245

[22] Filed: Feb. 20, 1997

[30] Foreign Application Priority Data

Feb. 21, 1996 [DE] Germany ..... 196 06 204

[51] Int. Cl.[6] ..... E05C 17/04

[52] U.S. Cl. ..... 292/270; 49/1; 49/379; 292/201; 292/DIG. 65; 292/55; 292/25

[58] Field of Search ..... 292/25, 45, 270, 292/273, 274, 278, 92, 55, 201, DIG. 65; 49/31, 379, 1

[56] References Cited

U.S. PATENT DOCUMENTS

| | | | |
|---|---|---|---|
| 2,171,065 | 8/1939 | Johnson | 292/278 |
| 2,173,671 | 9/1939 | Webber | 292/25 |
| 2,948,560 | 8/1960 | Rop | 292/45 |
| 3,164,404 | 1/1965 | Arnold | 292/273 |
| 3,601,842 | 8/1971 | Morrison et al. | 292/274 |
| 3,648,326 | 3/1972 | Gaysowski | 292/273 |
| 3,771,823 | 11/1973 | Schnarr . | |
| 4,040,143 | 8/1977 | Lasier et al. | 292/273 |
| 4,286,412 | 9/1981 | Stevens | 292/270 |
| 4,715,146 | 12/1987 | Atsumi et al. | 49/1 |
| 4,750,236 | 6/1988 | Teague, Jr. | 292/270 |
| 5,044,680 | 9/1991 | Baker et al. | 292/278 |
| 5,072,973 | 12/1991 | Gudgel et al. . | |
| 5,450,651 | 9/1995 | Coleman et al. | 292/274 |
| 5,551,187 | 9/1996 | Brouwer et al. | 292/DIG. 66 |

*Primary Examiner*—Darnell M. Boucher
*Attorney, Agent, or Firm*—Nils H. Ljungman and Associates

[57] ABSTRACT

An electromechanical locking mechanism for door leaves whose holding force can be adjusted continuously and which at the same time offers the possibility, when the locking mechanism is energized, of also releasing the closed door from and returning it to the locked position.

6 Claims, 6 Drawing Sheets

ELECTROMECHANICAL LOCKING MECHANISM FOR DOOR LEAVES HAVING A DOOR CLOSING DEVICE

BACKGROUND OF THE INVENTION

1. Field of the Invention

The invention relates to an electromechanical locking mechanism for door leaves which are fitted with a closing means more specifically in the form of a door closing device. The closing shaft of the door closing device is connected to one end of a pivot arm and the other end of the pivot arm is displaceable in the longitudinal direction by way of a slider in a guide rail. The slider co-operates with a locking mechanism which fixes the door leaf in a predetermined open position. In the event of any dangerous situation, such as for example a fire, a detector generally releases the lock on the door leaf, so that the door leaf can move reliably into the closed position by virtue of the energy stored in the spring-loading device of the door closing device.

2. Background Information

An electric locking mechanism for door leaves is disclosed in U.S. Pat. No. 3,771,823. A guide roller, which is connected by way of an actuating arm to the door closing device attached to the door, is located within a guide rail. Above the guide tracks for the sliding rollers, a further guide track is provided in the guide rail, in which further guide track a retaining member, connected directly to the roller located below, can be displaced likewise in a longitudinal direction within the rail. In addition thereto, provided in the guide rail is a recess at which the locking mechanism is mounted on a fixed fixing point. The locking mechanism consists in particular of a solenoid and attached to the armature of said solenoid is a push rod which is designed in such a manner that it penetrates between the two fixed claws, which it pivots in the outwards direction. This can, however, only happen if the retaining device of the slider is moved with its projections into the final position of the door and simultaneously the solenoid is energized. Consequently, the door is held in this position until a sensor signal for example causes the locking action of the magnet to be cancelled and thus the slider is released again. Owing to the type of construction involved, this guide rail is structurally extremely tall, as two chambers are provided in which on the one hand the sliding roller and on the other hand the retaining device can move separately from each other yet above each other mutually connected in the longitudinal direction. Moreover, it is also necessary for this type of locking operation to provide a holding piece in addition to the sliding roller. The retaining force cannot be adjusted.

A locking mechanism for door leaves is likewise disclosed in a further U.S. Pat. No. 5,072,973. The disadvantages, which are described in the case of the aforementioned locking mechanism, have likewise not been eliminated, as guide rails are also used which are structurally extremely tall and are provided with different guide chambers. In addition thereto, a motor is used to lock the door leaf and attached to the axle of the said motor is a spindle which can displace a retaining mechanism in the longitudinal direction in such a manner that the retaining projections located on the slider are held by two retaining arms.

OBJECT OF THE INVENTION

The object of the invention is to eliminate the disadvantages of the prior art and to produce an electromechanical locking mechanism which comprises simultaneously a manual-mechanical release of the locking action, whilst still allowing a continuous adjustment of the engaging and disengaging force.

SUMMARY OF THE INVENTION

The present invention teaches that in one preferred embodiment, this object can be accomplished by an arrangement in which a solenoid can be energized or de-energized. An actuating rod can be attached to the armature of the solenoid. The actuating rod can cooperate with two retaining claws which engage into a slider. There can preferably be no direct fixed connection between the solenoid and the retaining claws. A push rod of the solenoid can be attached to a connecting member. The connecting member can further receive a push rod axle. The push rod axle can be displaced in the axial direction and can be prevented from rotating at one end. An actuating rod can be provided on the end of the push rod axle protruding out of the connecting member. The connecting member can also have an adjusting nut against which a spring may be supported at one end. The other end of the spring can push against a projection of the push rod axle.

The locking mechanism which can be fixed at any point in the guide rail is constructed in such a manner that a solenoid comprises a push rod to which a connecting member is also attached. This connecting member is designed in such a manner that it comprises a bore in which a push rod axle can be mounted for displacement. This axle is secured by means of a pin to prevent it from rotating or falling out. Located on the outer side of the connecting member is an adjusting nut, which adjusts the resilient force of a spring, which abuts at one end against the adjusting nut and at the other end is held against an extension of the push rod axle by means of a disc. As a consequence, the push rod axle is urged in one direction, i.e. away from the solenoid. The push rod axle is further constructed in such a manner that it comprises at its free end an actuating rod which extends in a narrow acute angle. Furthermore, two moveable retaining claws, whose claws preferably point towards the outside, are attached to the base unit of the locking mechanism. If the armature of the solenoid is attracted, then the actuating rod pushes between the two claws, urging them in the direction of the walls of the guide rail.

Retaining projections, behind which the latching hooks of the retaining claws engage, are provided on the slider which is connected to one end of the actuating arm of the door closing device. As a consequence, the holding piece and thus the door are locked in a predetermined position.

If the door leaf is closed without the holding magnet being triggered, then the retaining claws squeeze together, simultaneously pushing the actuating rod against the resilient force in the direction of the attracted armature of the solenoid. This is possible as owing to the freedom of movement of the actuating rod within the connecting member this allows one direction of movement. This manual mechanical disengaging force, which must be used in order to move the door leaf out of the locked position, can be adjusted continuously by way of an adjusting nut.

An electromechanical locking device of the aforementioned type can thus also lock a door leaf even if the solenoid is energized but the slider has not moved into its engaging or locking position. Owing to the fact that the retaining claws can be pushed over, and after being pushed over they are brought back into their holding position automatically by means of the spring, it is possible in the normal operation for the armature of the solenoid to be permanently attracted. Similarly, if the solenoid is energized, then the slider can also be withdrawn from the holding position.

In other words, in one preferred embodiment, the locking mechanism can have a solenoid. The solenoid preferably has a push rod which can be extended and retracted by energizing and de-energizing the solenoid. A connecting member is preferably attached to the push rod. The connecting member is preferably hollow in order for one end of a push rod axle to be slidably disposed within the connecting member. The push rod axle can have an actuating rod, which actuating rod can come into contact with two retaining claw. The actuating rod may be wedge-shaped, with the tip oriented towards the retaining claws. A spring can be disposed between an adjusting nut placed on the outside of the connecting member and a disc-shaped abutment disposed on the push rod axle near the actuating rod. The spring is preferably used to move the actuating rod away from the solenoid and between the two retaining claws.

The retaining claws can be pivotably mounted on an assembly plate of the locking mechanism. The retaining claws can each have a surface which curves toward the guide rail and ends with a latching hook. The curved surface can come into contact with the actuating rod. As the actuating rod is moved between the retaining claws the latching hooks can be forced apart. An abutment attached to the assembly plate limits how far the retaining claws may be separated from one another. The latching hooks can have run-up surfaces which can contact bevels on retaining projections of a slider. The latching hooks can slide along the bevels, which sliding can force the latching hooks toward one another. The retaining projections can also have an inclined surface opposite the bevels which can come into contact with a latching surface of the latching hooks to hold the slider in a fixed position once the latching hooks extend between the retaining projections.

When the solenoid is energized the push rod and adjusting nut can extend away from the solenoid, this extension of the push rod and adjusting nut can increase the resilient force of the spring. The spring can then move the actuating rod between the two retaining claws and cause the latching hooks to move apart into a position ready to engage with the slider. A door closing device can then move the slider towards the latching hooks. As the latching hooks come into contact with the bevels of the retaining projections of the slider, the latching hooks can be forced towards one another. When the uppermost point of the bevels is preferably reached the latching hooks can extend between the retaining projections. Once the latching hooks are beyond the retaining projections, the latching hooks can then move apart again and come into contact with the inclined surfaces of the retaining projections to hold the slider in a fixed position. The resilient force of the spring pushing the actuating rod against the retaining claws can cause the latching hooks to form a frictional connection with the retaining projections and hold the slider in a fixed position.

The slider can be released from this fixed position by preferably removing the latching hooks from behind the retaining projections. One way to remove the latching hooks from behind the retaining projections can be by exerting a force which can cause the latching hooks to slide towards one another along the inclined surface of the retaining projections. Once the latching hooks reach the uppermost point of the inclined surface, the latching hooks can be retracted from between the retaining projections and the slider can once again be moved. One way to slide the latching hooks along the retaining projections can be to de-energize the solenoid. The de-energizing of the solenoid will preferably cause the push rod and connecting member to retract which in turn can reduce the resilient force of the spring acting on the retaining claws. A lower force acting on the retaining claws can preferably translate into a reduction of the frictional connection between the latching hooks and retaining projections. The slider can then be moved from its fixed position by the door closing device overcoming the frictional connection of the latching hooks and retaining projections and sliding the latching hooks out from between the retaining projections. A second way to slide the latching hooks from behind the retaining projections can be to manually overcome the frictional connection of the latching hooks and the retaining projections. A manual force greater than the resilient force of the spring can break the frictional connection between the latching hooks and retaining projections and can cause the latching hooks to slide toward one another along the inclined surface. The slider can then be moved once the latching hooks have been moved from behind the retaining projections. The resilient force of the spring can be adjusted by positioning the adjusting nut on the connecting member to achieve the desired resilient force acting upon the actuating rod and thus determining the manual mechanical force necessary to move the slider from its fixed position.

The entire locking mechanism can include an assembly plate and all components, such as particularly the solenoid, the retaining claws, the actuating rod and the connecting member, can be mounted thereon outside the guide rail. The completely assembled locking mechanism is then connected by way of screw elements to the guide rail in such a manner that it can be positioned continuously along the entire guide rail. This method of procedure renders it readily possible particularly in the retrofit business by replacing the slider and by installing the locking mechanism retroactively to provide a door with an electromechanical locking mechanism. The necessary supply lines must be provided to control the solenoid.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in detail with reference to an exemplified embodiment and a schematic illustration, in which.

DESCRIPTION OF THE PREFERRED EMBODIMENT

Figure 4:
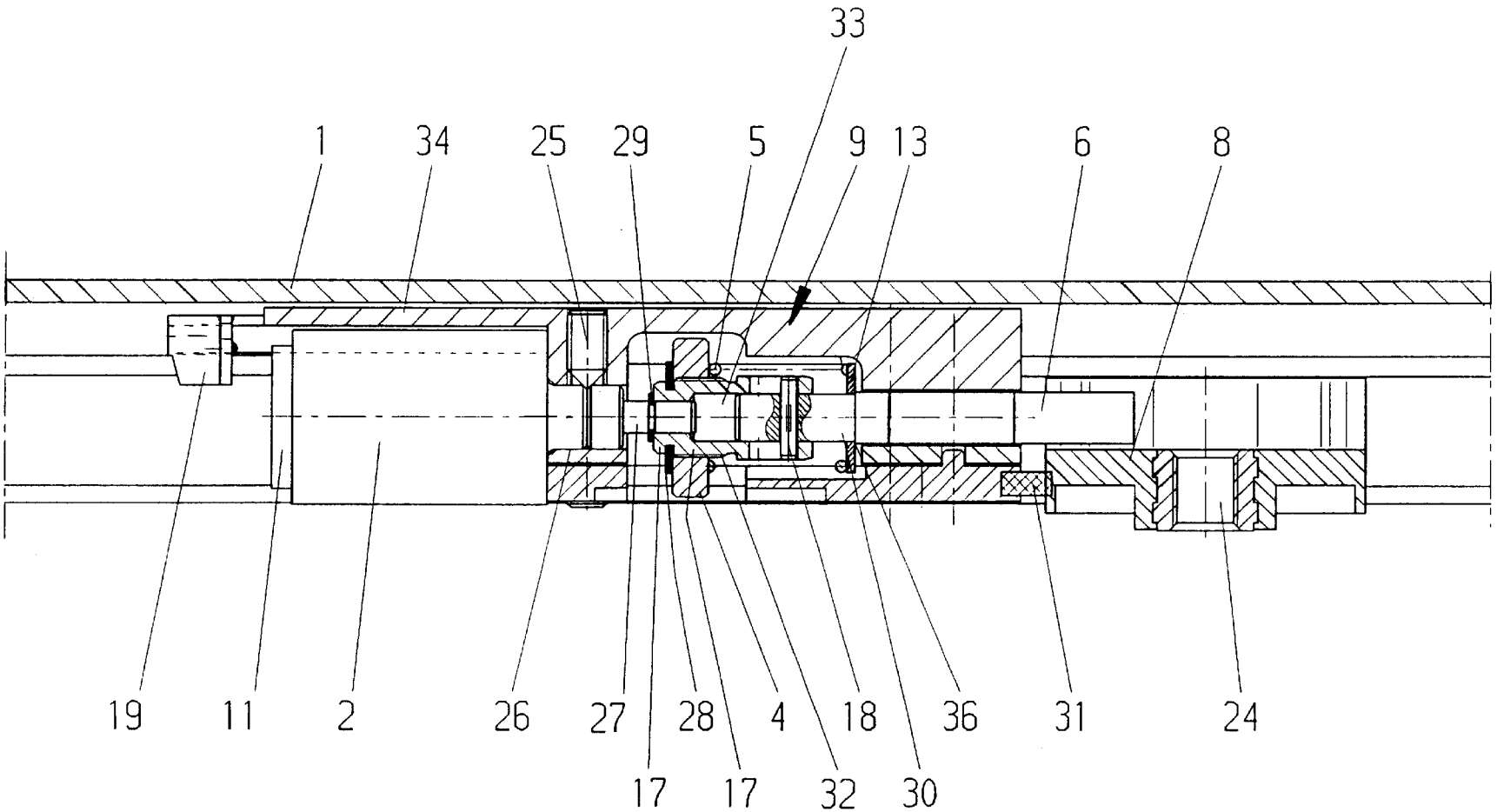
FIG. 4 shows a longitudinal sectional view through a locking mechanism which is inserted in a guide rail, FIG. 5. shows a locking mechanism with an engaged slider.
Figure 5:
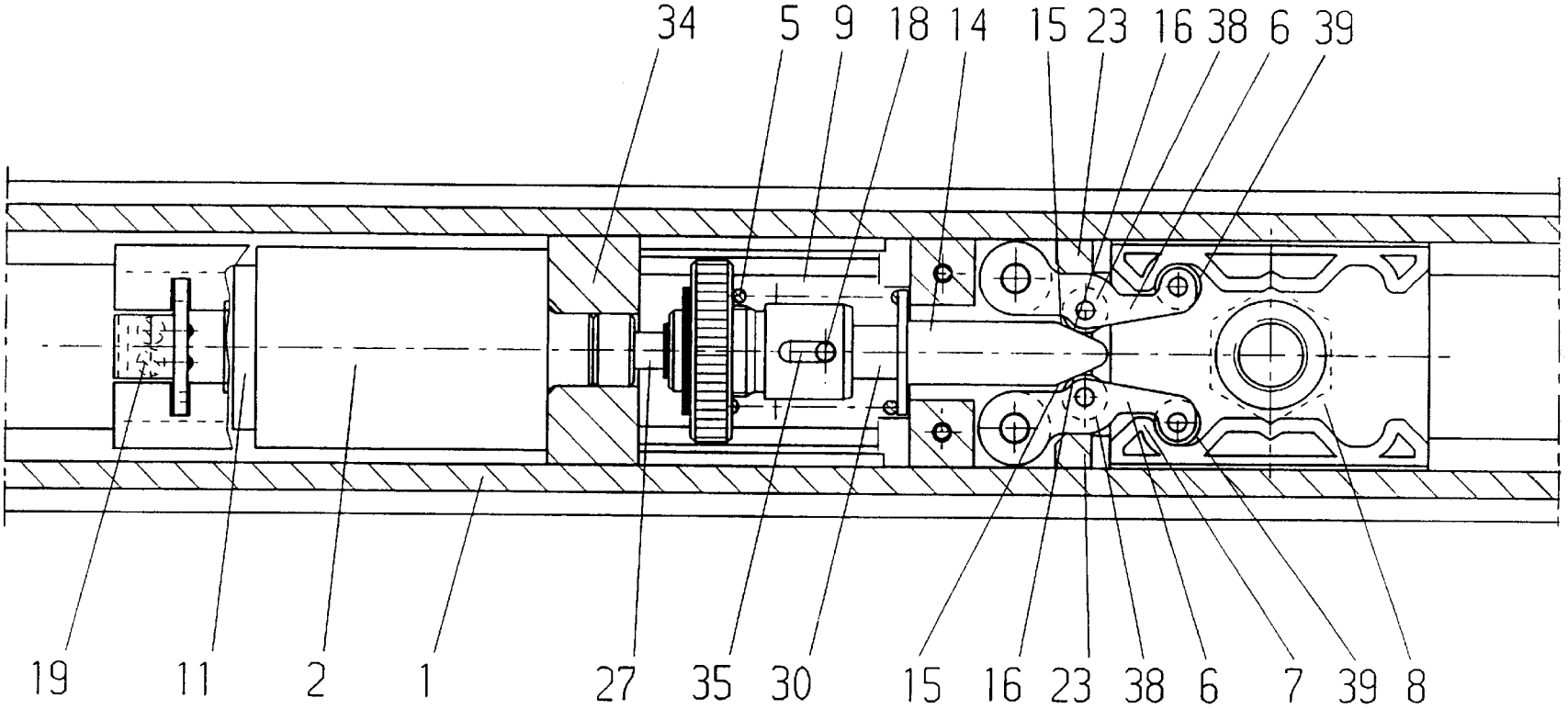

The locking mechanism 9 consists substantially of a solenoid 2 which is connected thereto on an assembly plate 34 by way of a fixing screw 25 positively and non-positively and moreover, to a device which is suitable for fixing a slider 8 which can be displaced in the longitudinal direction in a guide rail 1. The longitudinal sectional view of the guide rail 1 shown in FIG. 4 illustrates clearly the structure of the electromechanical locking mechanism according to the inventive idea. A connecting member 17 is fixedly connected to the push rod 27 which is moved in and out by the solenoid 2 by way of an armature plate 11 in the solenoid. The push rod 27 protrudes into the hollow connecting member 17 and secures the connecting member 17 by virtue of a securing ring 29 to prevent it from being released from the push rod 27. The connecting member 17 comprises in its longitudinal arrangement a bore 33 in which it is possible to displace a push rod axle 30 longitudinally. The push rod axle 30 is secured by means of a locking pin 18 to prevent rotation. The locking pin 18 is inserted in such a manner that it can be displaced longitudinally within two opposite slots 35 in the outer wall of the connecting member 17. The push rod axle is thus able to perform a predetermined stroke in the axial direction.

In another preferred embodiment of the present invention the solenoid 2 can have a piece which extends into a bore 26 of the assembly plate 34. The fixing screw 25 can extend through the assembly plate 34 and can come into contact with the piece of the solenoid 2 that is positioned inside the bore 26. The friction screw 25 can hold the solenoid 2 in place on the locking mechanism 9.

The push rod axle 30 comprises an extension 36 which lies outside the connecting member 17. In the continuation of the push rod axle this ends in an actuating rod 14 which is provided in the shape of a wedge with two inclined run-up surfaces 15, one on each side.

In other words and in accord with one preferred embodiment of the present invention, the push rod axle 30 can have an extension 36 which is preferably outside the connecting member 17. The extension 36 can then preferably extend into an actuating rod 14. The actuating rod 14 can have the shape of a wedge and can have a run-up surface 15 on each side.

A disc in the form of an abutment 13 lies against the extension 36 and a spring 5 comes to rest at one end against said disc. The other end of the spring 5 lies against an adjusting nut 4. The adjusting nut 4 can be continuously adjusted by way of a thread 32 which is also located on the connecting member 17. The resilient force of the spring 5 can be increased or reduced accordingly by means of the adjusting nut 4. It is thus possible by virtue of increasing or reducing the resilient force to determine the manual mechanical disengaging force of the slider 8. In order to prevent the adjusting nut 4 from being completely screwed down off the connecting member 17, a securing ring 28 is provided at one end, i.e. on the opposite side to which the spring 5 is resting.

As is evident from FIG. 4, the armature plate 11 of the solenoid is brought into the attracted position by virtue of the control operation via the connecting terminals 19 of the solenoid 2. As a consequence, the locking mechanism 9 holds the slider 8 in this position. A pivot arm of a door closing device is connected to the slider 8 by way of the fixing 24. In order to prevent the slider 8 from impacting the locking mechanism 9 by opening the door too far, a buffer 31 made from an elastic material is provided between the two.

Figure 1:
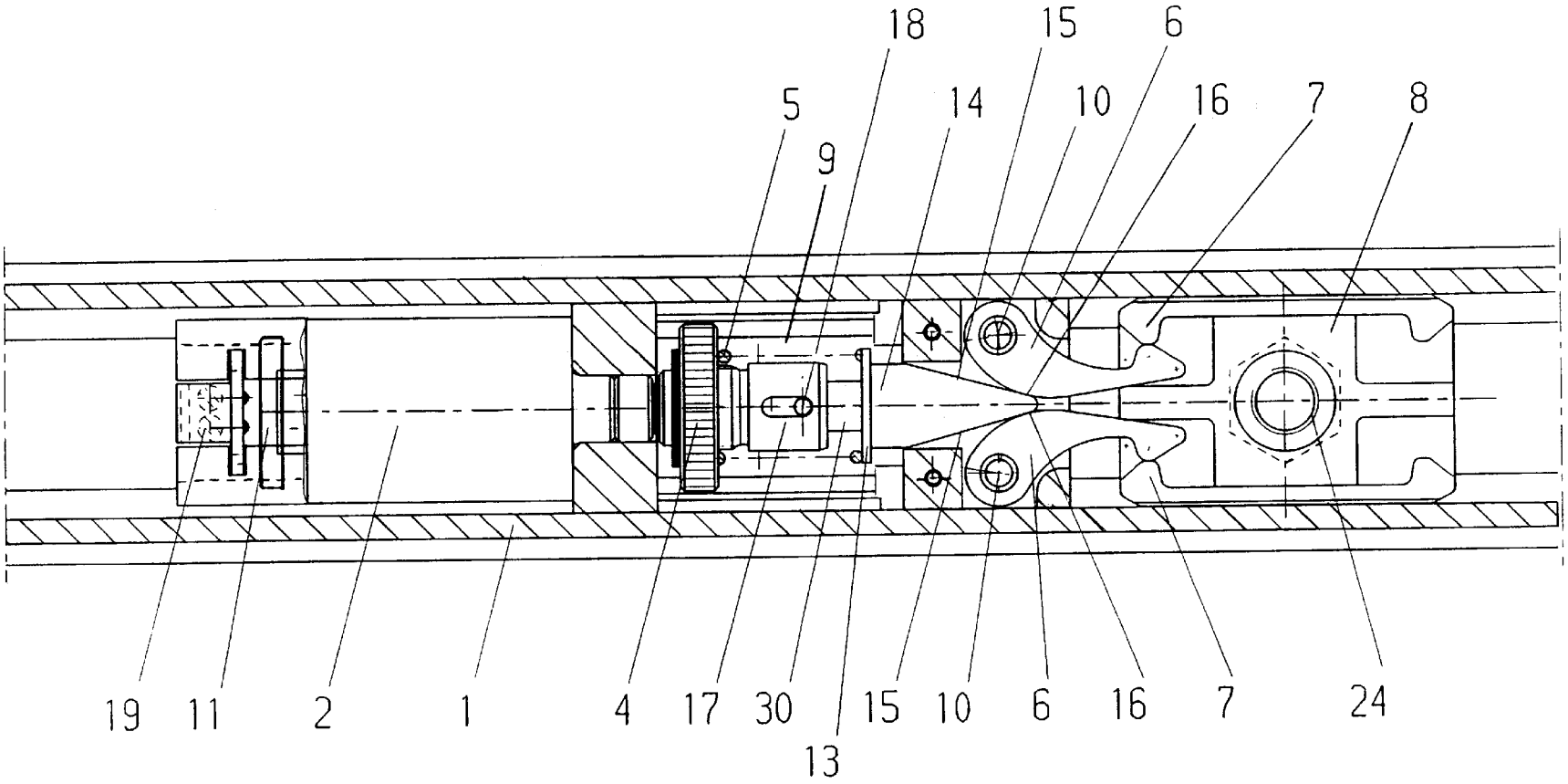
FIG. 1 shows a locking mechanism where the solenoid is not energized
Figure 2:
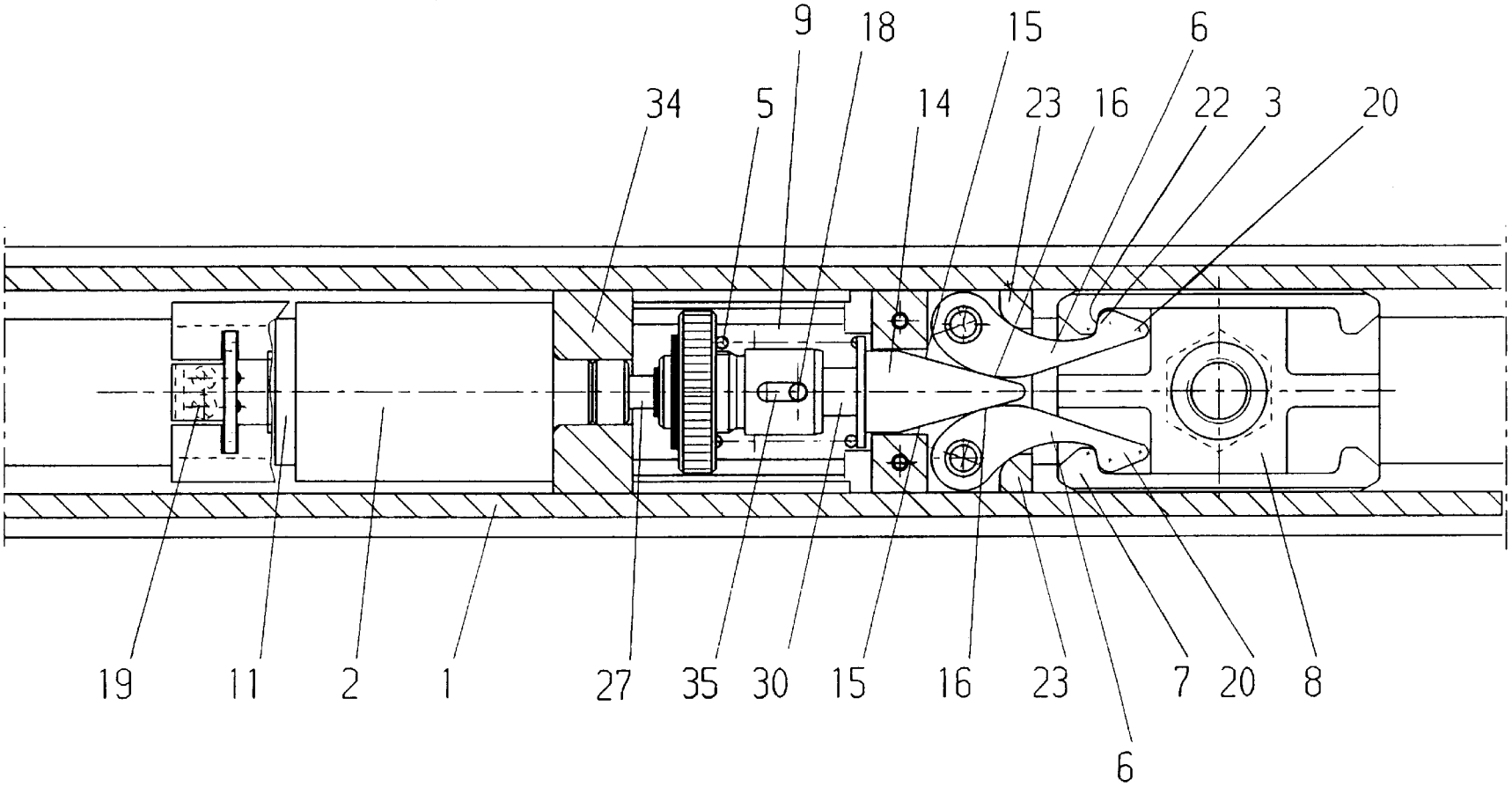
FIG. 2 shows a locking mechanism with the slider in the engaged position.

The position described in FIG. 4 is likewise illustrated in FIG. 2, however, in this case the guide rail has been illustrated in a position rotated by 90°, so that the entire construction both of the locking mechanism 9 and the engagement of the slider 8 is visible from below.

Two retaining claws 6 are located on the assembly plate 34 of the locking mechanism 9 on the opposite end of the solenoid 2. These retaining claws 6 are rotatably mounted so that they can be pivoted, should they come into contact with the actuating rod 14. The retaining claws 6 consist of flat components which comprise on one side a radius 16 which is curved outwards which terminates in a latching hook 20. The latching hook 20 has on the opposing side an inclined latching surface 3 which co-operates with a disengaging inclined surface 22, which is located on the slider 8, locking the door leaf.

In other words and in accord with one preferred embodiment of the present invention, the retaining claws 6 can be pivoted about a rotational point 10 if the run-up surfaces 15 of the actuating rod 14 come into contact with the radii 16 of the retaining claws.

As the illustration shows, the push rod movement 27 causes the actuating rod 14 to be pushed with its inclined run-up surfaces 15 between the two retaining claws 6 towards the radii 16. The adjusted force of the spring 5 thus holds the retaining claws 6 within the slider 8. However, abutments 23 are also located on the assembly plate 34 and ensure that the retaining claws 6 find a stop. The abutments 23 ensure that the retaining claws cannot be pushed apart to the extent that a locking operation with the slider is no longer possible.

If the control is now removed from the solenoid 2, i.e. the current is no longer supplied via the connecting terminals 19, then the pressure drops off at the connecting member 17. As a consequence, the armature plate 11 is simultaneously no longer attracted by the solenoid 2. Owing to the only limited travel which the locking pin 18 is allowed within the slots 35, it is necessary for the actuating rod 14 to be moved out of its latching position. The force, which is exerted on the claws 6 by the inclined run-up surfaces via the radii 16 of the retaining claws 6, is thus removed. The latching hooks 20 move out of their latching position behind the retaining projections 7, because the slider owing to the energy stored in the door closing device automatically pulls the slider 8 out of this position.

Figure 3:
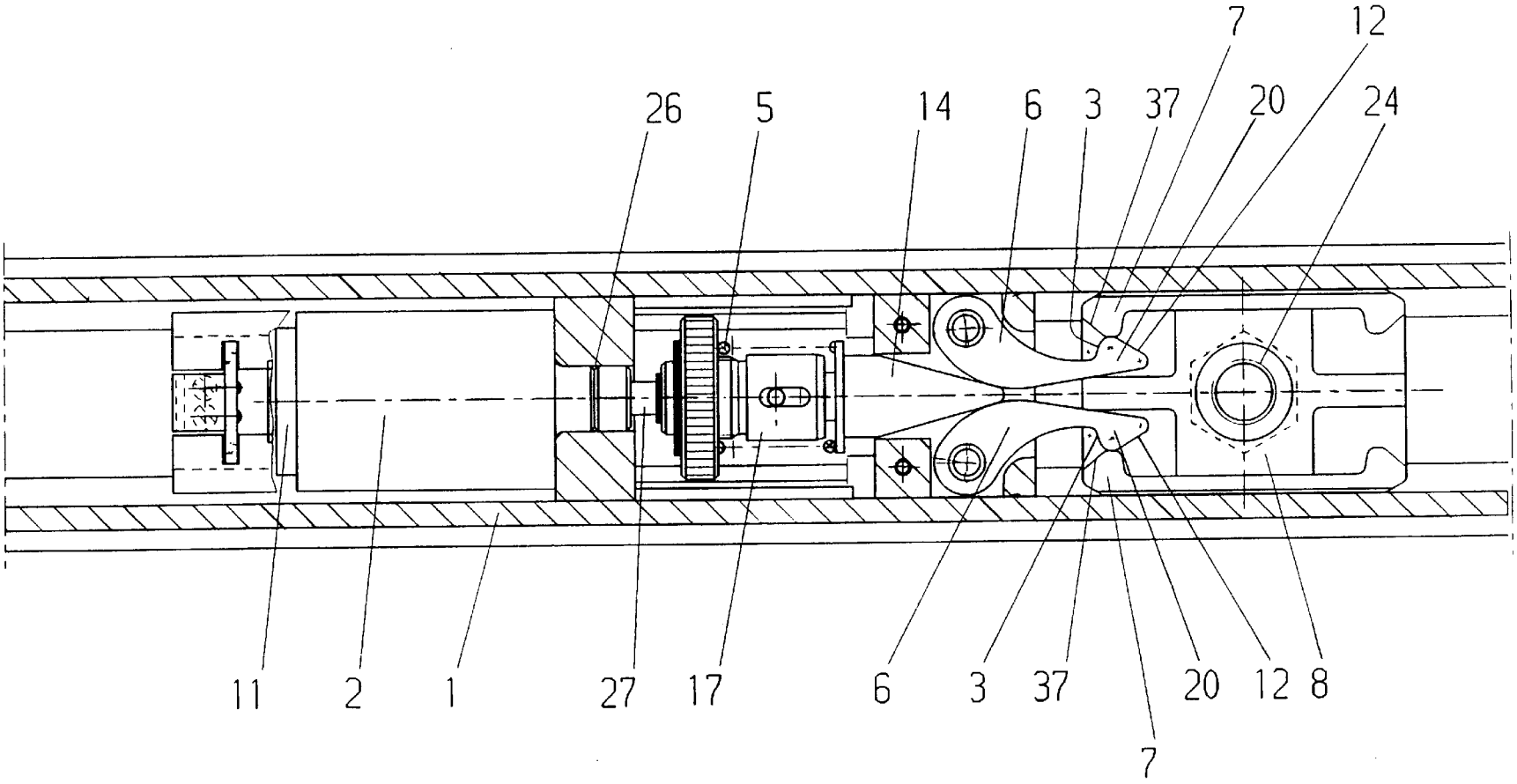
FIG. 3 shows a locking mechanism with an energized solenoid but where the locking action has been released by mechanical means.

FIG. 3 illustrates the operating condition which occurs when the solenoid 2 is energized and thus the push rod 27 pushes the connecting member 17 with the actuating rod 14 against the retaining claws 6. However, in this case, owing to a manual force exerted on the door the slider is drawn out of the holding position, which is made possible by the fact that owing to the extent of movement it is permitted by the push rod axle 30 of the actuating rod 14 within the connecting member 17. In other words, in this case the retaining claws 6 are pulled out of their position, and thus disengaged from behind the retaining projections 7, against the force exerted by the solenoid 2 and the spring 5, owing to the inclined disengaging surfaces 3 provided on the latching hooks. If the slider 8 is pulled back further from the locking mechanism, then the retaining claws 6 are simultaneously pushed in the outwards direction again into the locking position and thus against the abutment 23 owing to the still prevailing forces from the solenoid. In this position, the retaining claws are ready to lock a slider. This is rendered possible by virtue of the inclined run-up surfaces 12 which are located on the opposite sides of the inclined disengaging surfaces 3 on the latching hooks 20 of the retaining claws 6. In so doing, the inclined run-up surfaces 12 come into contact with the bevels 37 provided on the slider 8 in the region of the retaining projections 7. The force which is exerted on the door leaf causes in this case the retaining claws 6 to press together and as soon as the uppermost point of the retaining projections 7 is exceeded, the latching hooks 20 engage with the inclined latching surfaces 23 again in the slider 8, the door leaf can thus be locked if the solenoid is energized.

In other words and in accord with one preferred embodiment of the present invention, the slider 8 can be moved out of the locked position even when the solenoid 2 is energized. A manual mechanical force can be exerted on the slider 8 which can cause the latching surfaces 3 of the latching hooks 20 to slide up the inclined disengaging surface 22 of the retaining projections 7. The latching hooks 20 can then be removed from between the retaining projections 7 and can return to a position ready to engage with the slider 8. The slider 8 can then be returned to the locked position even while the solenoid 2 is energized. The run-up surfaces 12 of the latching hooks 20 can come into contact with the bevels 37 of the retaining projections 7. The latching hooks 20 can then be moved toward one another and extended between the retaining projections 7 to return the slider 8 to the locked position.

As the present description illustrates, it is also possible despite the locking mechanism being activated for the door leaf to be moved manually out of this position and it can also be moved into the locking position, without having to control the energizing of the solenoid. Owing to the fact that the entire locking mechanism 9 is quasi only clamped within the guide rail 1 at each point by virtue of an appropriately applied screw adjustment, it is possible to adjust continuously the locking angle for the closed door. Furthermore, in the event of the locking mechanism 9 becoming defective it can readily be replaced without having to dismantle the entire guide rail.

In order to increase the efficiency, a modified type can be used in a modified version of the above described design of retaining claws 6. This can for example be a modified type in which the retaining claws 6 comprise rollers 38 in the region of the contact point of the inclined run-up surfaces 15 of the actuating rod 14. Furthermore, the latching hooks 20 can likewise be provided with rollers 39 in the end region of the retaining claws 6. Whereas the rollers 38, as seen from the retaining claws 6, point inwards, the rollers 39 in the region of the latching hooks 20 point outwards. By virtue of this feature, a movement into the slider 8 behind the retaining projections 7 is more readily possible and moreover, both the inward movement of the actuating rod 14 between the two retaining claws 6 and also the outward movement of this actuating rod 14 is again facilitated.

Figure 6:
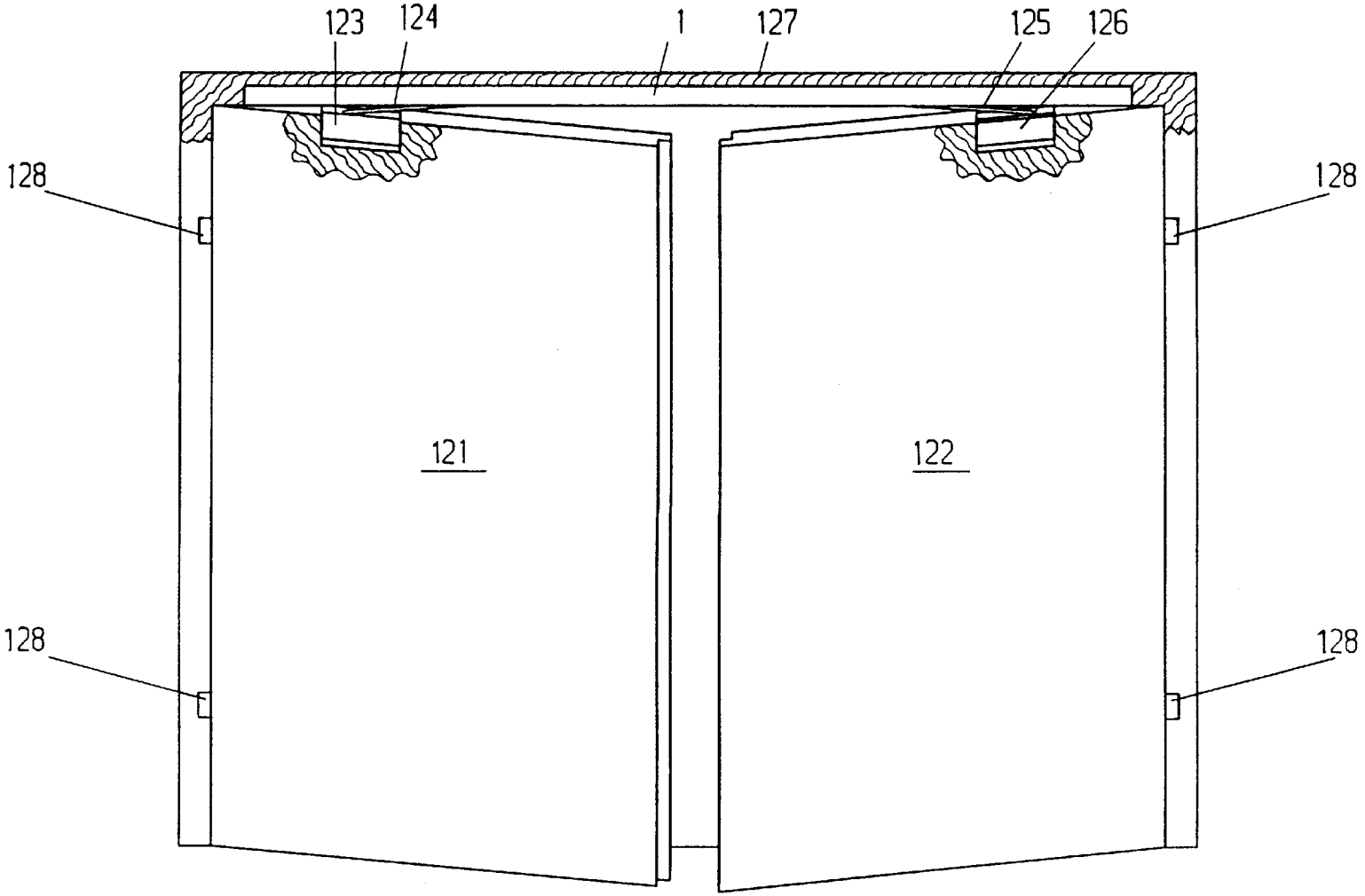
FIG. 6 shows a two-panel door with a door closing device.

FIG. 6 illustrates one preferred embodiment of a door closing mechanism. The guide rail or guide track 1 is preferably mounted in a door frame 127. The slider 8 (not shown) and the locking mechanism 9 (not shown) would be.mounted in the guide rail 1. One or more doors 121 can be mounted to the door frame 127 by hinges 128. A door closing device 123 can be mounted on the door 121. A pivot arm 124 can connect the door closing device 123 to the slider 8 in the guide rail 1.

One feature of the invention resides broadly in the electromechanical locking mechanism for door leaves which are fitted with a door closing device of a type such that its closing shaft is coupled to one end of a pivot arm and the other end thereof engages by way of a slider in a guide rail in such a manner as to be able to be displaced in a longitudinal manner and the slider co-operates with a locking mechanism, wherein the locking mechanism comprises a solenoid which can be energized or de-energized and attached to the armature thereof is an actuating rod which co-operates with two retaining claws which engage into the slider, characterized by the fact that there is no direct fixed connection between the solenoid (2) and the retaining claws (6) and a push rod (27) of the solenoid (2) is attached to a connecting member (17) and simultaneously the connecting member (17) receives a push rod axle (30) which can be displaced in the axial direction and is prevented from rotating at one end and an actuating rod (14) is provided on the end protruding out of the connecting member (17), and the connecting member (17) comprises an adjusting nut (4), against which a spring (5) is supported at one end and the other end of the spring (5) pushes against a projection of the push rod axle (30).

Another feature of the invention resides broadly in the electromechanical locking mechanism characterized in that when the armature plate (11) of the solenoid (2) is attracted the actuating rod (14) pushes between the two retaining claws (6), wherein the actuating stroke of the retaining claws (6) is limited in each case by an abutment (23).

Yet another feature of the invention resides broadly in the electromechanical locking mechanism characterized in that the slider (8) can also be fixed by the locking mechanism (9) if the solenoid (2) is energized.

Still another feature of the invention resides broadly in the electromechanical locking mechanism characterized by the fact that an elastic buffer (31) is provided between the locking mechanism (9) and the slider (8).

A further feature of the invention resides broadly in the electromechanical locking mechanism characterized in that the manual mechanical force in order to disengage the retaining claws (6) out of the slider (8) can be adjusted continuously.

Another feature of the invention resides broadly in the electromechanical locking mechanism characterized in that the locking mechanism (9) can be continuously adjusted within the guide rail (1).

Yet another feature of the invention resides broadly in the electromechanical locking mechanism characterized in that the retaining claws (6) comprise rollers (38) in the contact point of the inclined run-up surfaces of the actuating rod (14).

Still another feature of the invention resides broadly in the electromechanical locking mechanism characterized in that the retaining claws (6) comprise rollers (39) in the end region of the latching hooks (20).

Examples of door closers in which the present invention may be utilized or adapted for use in the context of the present invention may be disclosed in the following patents: U.S. Pat. No. 5,417,013, entitled "Overhead Door Closer With Slide Rail for Concealed Installation in Door Panels or Door Frames"; U.S. Pat. No. 5,461,754, entitled "Door Closer With a Detent for Holding a Door Open and the Detent Therefor", U.S. Pat. No. 5,369,912, entitled "Door and Method for Operating a Door", U.S. Pat. No. 5,205,015, entitled "Door Hinge with Automatic Returning Means", U.S. Pat. No. 5,222,328, entitled "Automatic Opening and Closing Device for Back Door", U.S. Pat. No. 5,265,306, entitled "Automatic Door Closing Device"; U.S. Pat. No. 5,265,311, entitled "Self Closing Hinge", U.S. Pat. No. 5,333,355, entitled "Adjustable Automatic Door Closure Apparatus and Method for Use Thereof"; and U.S. Pat. No. 5,311,642 entitled "A Door Closer with a Detent for Holding a Door Open & The Detent Therefor".

Examples of door holders in which the present invention may be utilized or adapted for use in the context of the present invention may be disclosed in the following patents: U.S. Pat. No. 3,771,823 entitled "Electrically Controlled Hold-Open Device"; U.S. Pat. No. 5,072,973 entitled "Door Hold Open Device"; U.S. Pat. No. 5,426,820 entitled "Modular Reduced Friction Overhead Door Holder Assembly"; U.S. Pat. No. 5,448,797 entitled "Selectable Friction Assisted Door Holder Assembly"; and U.S. Pat. No. 5,448,798 entitled "Low Profile Overhead Mounted Door Holder Assembly".

U.S. patent application, Ser. No. 08/597,131, filed Feb. 6, 1996, now U.S. Pat. No. 5,651,216, entitled "Door Closer for a Two-Panel Door with a Closing Sequence Control Mechanism", having inventor Horst Tillmann and claiming priority from German Application Number 295 01 776.7, DE-OS 295 01 776.7 and DE-PS 295 01 776.7, is hereby incorporated by reference as if set forth in its entirety herein.

The following U.S. patent applications: Ser. No. 08/725,744, filed Oct. 4, 1996 now U.S. Pat. No. 5,823,026, having the title "Locking Device for a Door"; Ser. No 08/664,401, filed Jun. 17, 1996, now U.S. Pat. No. 5,789,887 having the title "Automatic Door"; and Ser. No. 08/735,414, filed Oct. 22, 1996, now U.S. Pat. No. 5,802,670 having the title "Door Closer" are hereby incorporated by reference as if set forth in their entirety herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 196 06 204.7, filed on Feb. 21, 1996, having inventor Bernd Winkler, and DE-OS 196 06 204.7 and DE-PS 196 06 204.7, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A door closing mechanism, said door closing mechanism comprising:

a guide track;

a slider;

said slider being disposed to move back and forth in said guide track;

a mechanism to connect said slider to a door;

a locking mechanism to hold said slider in a fixed position within said guide track;

said locking mechanism being disposed within said guide track; and said locking mechanism comprising:

at least two retaining claws to retain said slider in a fixed position within said guide track;

each of said at least two retaining claws having a corresponding axis of rotation;

each of said at least two retaining claws being mounted to pivot about its corresponding axis of rotation;

each of said at least two retaining claws being configured to engage with said slider and to hold said slider in a fixed position within said guide track;

a rod being disposed to pivot each of said at least two retaining claws about its corresponding axis of rotation;

said rod being disposed between said at least two retaining claws;

said rod being disposed to make contact with each of said at least two retaining claws and to permit engagement and disengagement of said at least two retaining claws with said slider;

a biasing structure to bias said rod between said at least two retaining claws to permit engagement and disengagement of said at least two retaining claws with said slider;

an adjusting device to adjust the bias of said biasing structure; and an actuator to actuate said rod and to permit engagement and disengagement of said at least two retaining claws with said slider;

said actuator comprising a solenoid;

said solenoid having an energized state and a de-energized state;

said solenoid being configured and disposed to extend and retract said rod in response to said solenoid being in one of the energized state and the de-energized state;

said biasing structure comprising at least one spring;

said at least one spring being disposed to make contact with said adjusting device;

said at least one spring being disposed to make contact with said rod to bias said rod between said at least two retaining claws;

said adjusting device comprising a nut;

said nut being disposed to make contact with said at least one spring;

said nut being configured and disposed to be displaceable to set the bias of said at least one spring;

said locking mechanism comprising an arrangement disposed to limit the pivoting of each of said at least two retaining claws to a position permitting engagement of said slider with said at least two retaining claws;

said actuator comprising a connecting member;

said connecting member comprising a substantially cylindrical outer surface;

said connecting member comprising a boring disposed therein;

said connecting member being operatively connected to said solenoid;

said nut being disposed on said substantially cylindrical surface of said connecting member;

said rod comprising a first end and a second end;

said first end of said rod being disposed between said at least two retaining claws;

said second end of said rod being slidably disposed within said boring of said connecting member;

said connecting member comprising at least one slot;

said at least one slot being disposed in said outer cylindrical surface of said connecting member;

said second end of said rod comprising a pin;

said pin being at least partially disposed within said at least one slot to prevent rotation of said rod; and said at least one slot being disposed in said outer cylindrical surface of said connecting member to permit said second end of said rod and said pin to be displaced a predetermined distance within said boring of said connecting member.

2. The door closing mechanism according to claim 1, wherein:

said slider comprises at least two projections;

each of said at least two projections is disposed to engage with a corresponding one of said at least two retaining claws to hold said slider in a fixed position within said guide track;

each of said at least two retaining claws comprises a hook portion;

said hook portion of each of said at least two retaining claws is disposed to engage with said corresponding one of said at least two projections of said slider to hold said slider in a fixed position within said guide track;

each of said at least two retaining claws comprises a substantially curved surface;

said substantially curved surfaces are disposed to make contact with said first end of said rod; and said substantially curved surfaces have a substantially convex shape.

3. The door closing mechanism according to claim 2, wherein:

said curved surface of each of said at least two retaining claws comprises a first roller;

each said first roller is disposed to make contact with said first end of said rod;

said hook portion of each of said at least two retaining claws comprises a second roller; and said second roller of said hook portion of each of said at least two retaining claws is disposed to engage with said corresponding one of said at least two projections of said slider to hold said slider in a fixed position within said guide track.

4. The door closing mechanism according to claim 3, further comprising:

a stop portion;

said stop portion being disposed between said slider and said locking mechanism to prevent said slider from impacting said locking mechanism;

said stop portion comprising an elastic material;

an arrangement to continuously adjust the position of said locking mechanism in said guide track;

said solenoid comprising:

a push rod;

at least a portion of said push rod being disposed in said boring of said connecting member to make contact with said second end of said rod;

an armature plate;

said armature plate being configured and disposed to displace said push rod into and out of said solenoid;

at least one terminal; and said at least one terminal being configured and disposed to move said armature plate;

said actuator comprising a first securing ring to connect said push rod to said connecting member;

said connecting mechanism comprising a closing device;

said closing device to be operatively connected to a door;

said connecting mechanism comprising a pivot arm;

said pivot arm comprising a first end and a second end;

said first end of said pivot arm being operatively connected to said closing device;

said second end of said pivot arm being operatively connected to said slider;

said first end of said rod being substantially wedge-shaped;

said adjusting device comprising;

a first threaded portion;

said first threaded portion being disposed on said outer cylindrical surface of said connecting member;

a second threaded portion;

said second threaded portion being disposed on said nut; and said second threaded portion being configured to mate with said first threaded portion to continuously adjust the position of said nut on said outer cylindrical surface of said connecting member;

said adjusting device comprising a second securing ring;

said second securing ring being disposed on said connecting member to prevent said nut from being removed from a side of said connecting member adjacent to said solenoid;

said limiting arrangement being disposed between said at least two retaining claws and said guide track;

said locking mechanism being configured to engage with said slider in response to said solenoid being in the energized state;

said rod comprising an abutment;

said abutment being disposed between said first end and said second end of said rod;

said abutment being substantially disc shaped; and said at least one spring being disposed to make contact with said abutment of said rod and to bias said rod between said at least two retaining claws.

5. A door closing mechanism, said door closing mechanism comprising:

a guide track;

a slider;

said slider being disposed to move back and forth in said guide track;

a mechanism to connect said slider to a door;

a locking mechanism to hold said slider in a fixed position;

said locking mechanism being disposed within said guide track; and said locking mechanism comprising:

at least one retaining claw to retain said slider in a fixed position within said guide track;

said at least one retaining claw having an axis of rotation;

said at least one retaining claw being mounted to pivot about its axis of rotation;

said at least one retaining claw being configured to engage with said slider and to hold said slider in a fixed position within said guide track;

a rod being disposed to pivot said at least one retaining claw about its axis of rotation;

said rod being disposed adjacent to said at least one retaining claw;

said rod being disposed to make contact with said at least one retaining claw and to permit engagement and disengagement of said at least one retaining claw with said slider;

a biasing structure to bias said rod adjacent to said at least one retaining claw to permit engagement and disengagement of said at least one retaining claw with said slider;

an adjusting device to adjust the bias of said biasing structure; and an actuator to actuate said rod and to permit engagement and disengagement of said at least one retaining claw with said slider;

said actuator comprising a solenoid;

said solenoid having an energized state and a de-energized state;

said solenoid being configured and disposed to extend and retract said rod in response to said solenoid being in one of the energized state and the de-energized state;

said biasing structure comprising a spring;

said spring being disposed to make contact with said adjusting device;

said spring being disposed to make contact with said rod to bias said rod adjacent to said at least one retaining claw;

said adjusting device comprising a nut;

said nut being disposed to make contact with said spring;

said nut being configured and disposed to be displaceable to set the bias of said spring;

said locking mechanism comprising an arrangement disposed to limit the pivoting of said at least one retaining claw to a position permitting engagement of said slider with said at least one retaining claw;

said actuator comprising a connecting member;

said connecting member comprising a substantially cylindrical outer surface;

said connecting member comprising a boring disposed therein;

said connecting member being operatively connected to said solenoid;

said nut being disposed on said substantial cylindrical outer surface of said connecting member;

said rod comprising a first end and a second end;

said first end of said rod being disposed adjacent to said at least one retaining claw;

said second end of said rod being slidably disposed within said boring of said connecting member;

said connecting member comprising at least one slot;

said at least one slot being disposed in said outer cylindrical surface of said connecting member;

said second end of said rod comprising a pin;

said pin being at least partially disposed within said at least one slot to prevent rotation of said rod;

said at least one slot being disposed in said outer cylindrical surface of said connecting member to permit said second end of said rod and said pin to be displaced a predetermined distance within said boring of said connecting member;

said slider comprising at least one projection, said at least one projection being disposed to engage with said at least one retaining claw to hold said slider in a fixed position within said guide track;

said at least one retaining claw comprising a hook portion;

said hook portion of said at least one retaining claw being disposed to engage with said at least one projection of said slider to hold said slider in a fixed position within said guide track;

said at least one retaining claw comprising a substantially curved surface;

said substantially curved surface being disposed to make contact with said first end of said rod; and said substantially curved surface having a substantially convex shape.

6. The door closing mechanism according to claim 5, further comprising:

a stop portion;

said stop portion being disposed between said slider and said locking mechanism to prevent said slider from impacting said locking mechanism;

said stop portion comprising an elastic material;

an arrangement to continuously adjust the position of said locking mechanism in said guide track;

said solenoid comprising:

a push rod;

at least a portion of said push rod being disposed in said boring of said connecting member to make contact with said second end of said rod;

an armature plate;

said armature plate being configured and disposed to displace said push rod into and out of said solenoid; at least one terminal;

said at least one terminal being disposed to move said armature plate;

said actuator comprising a first securing ring to connect said push rod to said connecting member;

said substantially curved surface of said at least one retaining claw comprising a first roller;

said first roller being disposed to make contact with said first end of said rod;

said hook portion of said at least one retaining claw comprising a second roller;

said second roller of said hook portion of said at least one retaining claw being disposed to engage with said at least one projection of said slider to hold said slider in a fixed position within said guide track;

said connecting mechanism comprising a closing device;

said closing device being operatively connected to a door;

said connecting mechanism comprising a pivot arm;

said pivot arm comprising a first end and a second end;

said first end of said pivot arm being operatively connected to said closing device;

said second end of said pivot arm being operatively connected to said slider;

said first end of said rod is substantially wedge-shaped;

said adjusting device comprising:

a first threaded portion;

said first threaded portion being disposed on said outer cylindrical surface of said connecting member;

a second threaded portion;

said second threaded portion being disposed on said nut; and said second threaded portion being configured to mate with said first threaded portion to continuously adjust the position of said nut on said connecting member;

said adjusting device comprising a second securing ring;

said second securing ring being disposed on said connecting member to prevent said nut from being removed from a side of said connecting member adjacent to said solenoid;

said limiting arrangement being disposed between said at least one retaining claw and said guide track;

said locking mechanism being configured to engage with said slider in response to said solenoid being in the energized state;

said rod comprising an abutment;

said abutment being disposed between said first end and said second end of said rod; and said spring being disposed to make contact with said abutment of said rod and to bias said rod adjacent to said at least one retaining claw.

* * * * *